US010107298B2

(12) United States Patent
Shoyama et al.

(10) Patent No.: US 10,107,298 B2
(45) Date of Patent: Oct. 23, 2018

(54) TURBO MACHINE

(71) Applicant: Panasonic Intellectual Property Management Co., Ltd., Osaka (JP)

(72) Inventors: Tadayoshi Shoyama, Osaka (JP); Takeshi Ogata, Osaka (JP); Hidetoshi Taguchi, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 344 days.

(21) Appl. No.: 15/177,298

(22) Filed: Jun. 8, 2016

(65) Prior Publication Data

US 2017/0016452 A1 Jan. 19, 2017

(30) Foreign Application Priority Data

Jul. 17, 2015 (JP) ..... 2015-142591

(51) Int. Cl.

| | |
|---|---|
| ***F04D 29/053*** | (2006.01) |
| ***F04D 29/056*** | (2006.01) |
| ***F04D 29/047*** | (2006.01) |
| ***F04D 29/057*** | (2006.01) |
| ***F04D 29/063*** | (2006.01) |

(Continued)

(52) U.S. Cl.

CPC ..... *F04D 29/056* (2013.01); *F04D 29/0473* (2013.01); *F04D 29/053* (2013.01); *F04D 29/057* (2013.01); *F04D 29/063* (2013.01); *F04D 29/284* (2013.01); *F04D 17/10* (2013.01); *F05D 2240/52* (2013.01); *F05D 2240/53* (2013.01); *F05D 2240/61* (2013.01); *F05D 2240/63* (2013.01)

(58) Field of Classification Search

CPC .... F04D 29/056; F04D 29/057; F04D 29/063; F04D 29/284

See application file for complete search history.

(56) References Cited

U.S. PATENT DOCUMENTS 4,013,384 A * 3/1977 Oikawa ..... F04D 3/02 415/10
4,251,985 A * 2/1981 Sullivan ..... F02C 9/18 415/27
6,457,311 B2 * 10/2002 Fledersbacher ..... F01D 25/166 417/407

FOREIGN PATENT DOCUMENTS

JP 58-196319 11/1983
JP 58196319 U * 12/1983 ..... F16C 32/06

* cited by examiner

*Primary Examiner* — Woody Lee, Jr.
(74) *Attorney, Agent, or Firm* — McDermott Will & Emery LLP

(57) ABSTRACT

A turbo machine according to the present disclosure includes a rotating shaft, an impeller, a first bearing, and a first supply passage. The rotating shaft includes a first taper portion and a first cylindrical portion. The first bearing includes a first taper support surface and a first cylindrical portion support surface, the first taper support surface including a first taper hole forming surface and rotatably supporting the first taper portion, the first cylindrical portion support surface rotatably supporting the first cylindrical portion. The first supply passage is open to a space formed between the first cylindrical portion and first cylindrical portion support surface. An inclination angle of the first taper hole forming surface with respect to the axial direction of the first bearing is greater than an inclination angle of an outer surface of the first taper portion with respect to the axial direction of the rotating shaft.

5 Claims, 11 Drawing Sheets

(51) Int. Cl.
*F04D 29/28* (2006.01)
*F04D 17/10* (2006.01)

TURBO MACHINE

BACKGROUND

1. Technical Field

The present disclosure relates to a turbo machine.

2. Description of the Related Art

Existing turbo machines include a thrust bearing and a radial bearing, which are independent from each other. The thrust bearing supports an axial load (thrust load) generated due to a differential pressure between both surfaces of an impeller. The radial bearing supports a radial load. Some turbo machines include an angular ball bearing for supporting the thrust load and the radial load. Tapered roller bearings are known as bearings for supporting a rotating shaft.

FIG. 11 illustrates an air bearing device 500 described in Japanese Unexamined Patent Application Publication No. 58-196319, which includes a rotating shaft 501, a bearing member 503, a bearing member 504, an air bearing 506, an air bearing 507, a flow passage 508, and a flow passage 509. The air bearing 506 is disposed between the rotating shaft 501 and the bearing member 503. The air bearing 507 is disposed between the rotating shaft 501 and the bearing member 504. The flow passage 508 is formed in the bearing member 503, and the flow passage 509 is formed in the bearing member 504. Pressurized air is supplied to the air bearing 506 through the flow passage 508. Pressurized air is supplied to the air bearing 507 through the flow passage 509. The air bearing 506 and the air bearing 507 are tapered, and the large-diameter side of the air bearing 506 and the large-diameter side of the air bearing 507 face each other.

A pressure sensor 515 is disposed on the bearing surface of the bearing member 503. The pressure sensor 515 detects the pressure P in the air bearing 506, and an output signal p from the pressure sensor 515 is transmitted to a computing unit 516. The computing unit 516 converts the pressure P into a bearing clearance C and uses the bearing clearance C or the pressure P as a control signal. The value of the bearing clearance C is changed by moving the bearing member 503 rightward or leftward in FIG. 11 using a feed motor 514 so that the output signal p has a predetermined value. Thus, the bearing clearance C is maintained at the optimum value.

SUMMARY

A turbo machine including the air bearing device described in JAPANESE UNEXAMINED PATENT APPLICATION PUBLICATION NO. 58-196319 has room for improvement so that the turbo machine can have high efficiency. The present disclosure provides a turbo machine having high efficiency.

The present disclosure provides a turbo machine including a rotating shaft;

an impeller;

a first bearing that supports the rotating shaft; and a first supply passage for supplying a lubricating liquid between the rotating shaft and the first bearing, wherein the impeller is fixed to the rotating shaft, a working fluid intake side of the impeller facing the first bearing, the rotating shaft includes a first taper portion and a first cylindrical portion, the first taper portion increasing in diameter toward the impeller in an axial direction of the rotating shaft, the first cylindrical portion being located adjacent to a large diameter end of the first taper portion, the first bearing includes a first taper support surface and a first cylindrical portion support surface, the first taper support surface including a first taper hole forming surface that forms a taper hole that extends toward a small diameter end of the first taper portion from a particular point on the first bearing in an axial direction of the first bearing, the first taper support surface rotatably supporting the first taper portion via the lubricating liquid, the first cylindrical portion support surface rotatably supporting the first cylindrical portion via the lubricating liquid, the first supply passage is open to a space formed between the first cylindrical portion and the first cylindrical portion support surface, and an inclination angle of the first taper hole forming surface with respect to the axial direction of the first bearing is greater than an inclination angle of an outer surface of the first taper portion with respect to the axial direction of the rotating shaft.

The turbo machine has high efficiency.

DETAILED DESCRIPTION

Figure 1:
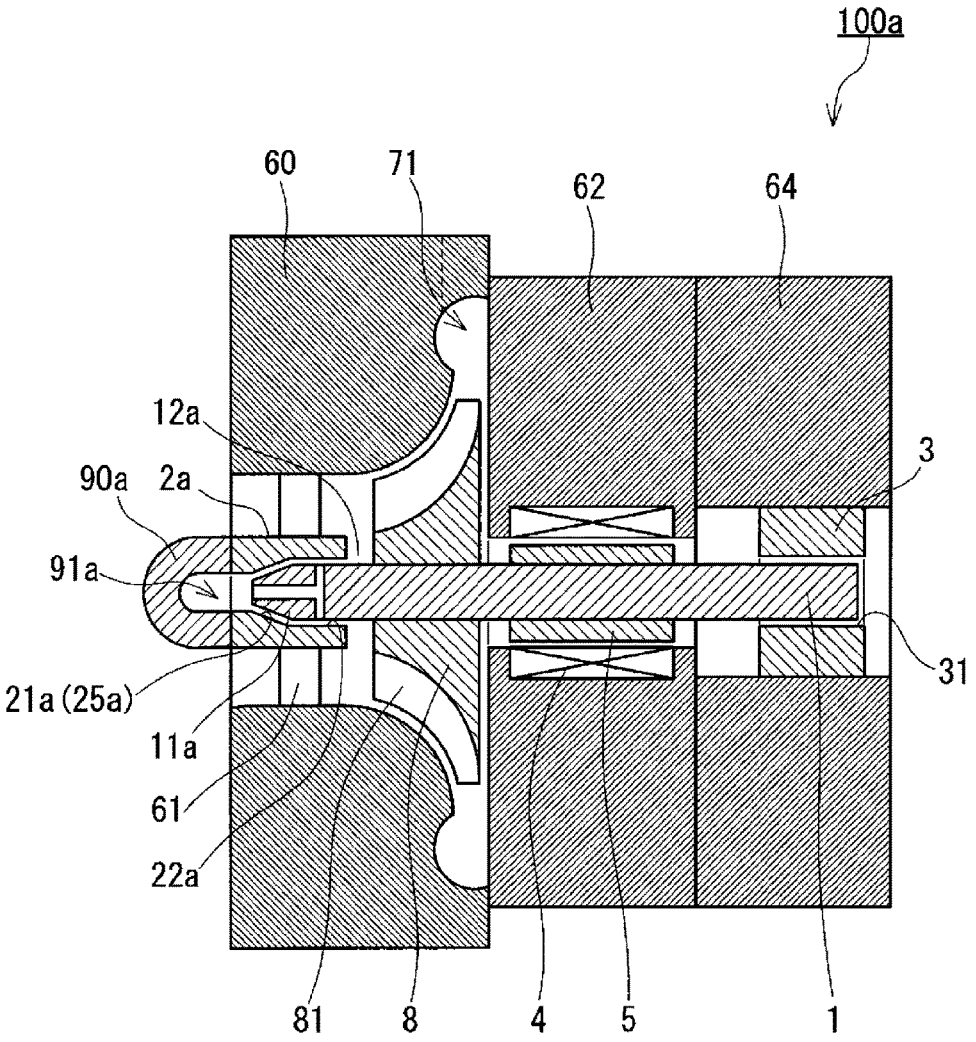
FIG. 1 is a sectional view of a turbo machine according to a first embodiment.

In the air bearing device 500 described in JAPANESE UNEXAMINED PATENT APPLICATION PUBLICATION NO. 58-196319, the air bearing 506 and the air bearing 507, each of which has a tapered shape, support a thrust load of the rotating shaft 501. The thrust load of the rotating shaft 501 is supported by a thrust support force that is generated by the air bearing 506 and the air bearing 507.

It may be possible to increase the maximum value of the thrust support force by increasing the diameter of a large diameter end of a taper portion of the rotating shaft 501 and thereby increasing the projection area of the taper portion of the rotating shaft 501 in the axial direction of the rotating shaft 501. In this case, however, the bearing loss may increase and the efficiency of the turbo machine may decrease.

A first aspect of the present disclosure provides a turbo machine including a rotating shaft;

an impeller;

a first bearing that supports the rotating shaft; and a first supply passage for supplying a lubricating liquid between the rotating shaft and the first bearing, wherein the impeller is fixed to the rotating shaft, a working fluid intake side of the impeller facing the first bearing, the rotating shaft includes a first taper portion and a first cylindrical portion, the first taper portion increasing in diameter toward the impeller in an axial direction of the rotating shaft, the first cylindrical portion being located adjacent to a large diameter end of the first taper portion, the first bearing includes a first taper support surface and a first cylindrical portion support surface, the first taper support surface including a first taper hole forming surface that forms a taper hole that extends toward a small diameter end of the first taper portion from a particular point on the first bearing in an axial direction of the first bearing, the first taper support surface rotatably supporting the first taper portion via the lubricating liquid, the first cylindrical portion support surface rotatably supporting the first cylindrical portion via the lubricating liquid, the first supply passage is open to a space formed between the first cylindrical portion and the first cylindrical portion support surface, and an inclination angle of the first taper hole forming surface with respect to the axial direction of the first bearing is greater than an inclination angle of an outer surface of the first taper portion with respect to the axial direction of the rotating shaft.

With the first aspect, the width of a space between the outer surface of the first taper portion and the first taper support surface in the vicinity of the small diameter end of the first taper portion is smaller than the width of a space between the outer surface of the first taper portion and the first taper support surface in the vicinity of the large diameter end of the first taper portion. Thus, the resistance against the flow of the lubricating liquid in the first bearing increases in the vicinity of the small diameter end of the first taper portion, and therefore the amount of change in the pressure of the lubricating liquid increases in the vicinity of the small diameter end of the first taper portion. On the other hand, the amount of change in the pressure of the lubricating liquid in a section inside the first bearing from the position at which the lubricating liquid is supplied to the position at which the lubricating liquid is discharged is constant, and therefore the amount of change in the pressure of the lubricating liquid is small in the vicinity of the large diameter end of the first taper portion. Accordingly, the average pressure of the lubricating liquid in the space between the first taper portion and the first taper support surface is high, and the maximum value of the thrust support force of the first bearing is high. Moreover, the maximum value of the thrust support force of the first bearing can be increased without increasing the diameter of the large diameter end of the first taper portion. Therefore, the bearing loss is reduced and the turbo machine has high efficiency.

A second aspect of present disclosure provides the turbo machine according to the first aspect, wherein an outer surface of the rotating shaft and an inner surface of the first bearing form an extended space at a position adjacent to the large diameter end of the first taper portion, the extended space having a width in the radial direction of the first bearing, the width being greater than a width of a space between an outer surface of the first cylindrical portion and the first cylindrical portion support surface. With the second aspect, because the extended space is formed at a position adjacent to the large diameter end of the first taper portion, the maximum value of the thrust support force of the first bearing is higher. Moreover, the thrust support force of the first bearing can be easily increased, even when the width between the small diameter end of the first taper portion and the first taper support surface is comparatively large.

A third aspect of present disclosure provides the turbo machine according to the second aspect, wherein the extended space is formed by the inner surface of the first bearing and the outer surface of the first taper portion, the inner surface extending from the first taper hole forming surface outward in the radial direction of the first bearing between the first cylindrical portion support surface and the first taper hole forming surface in the axial direction of the rotating shaft. With the third aspect, the extended space can be formed without performing special machining of the rotating shaft.

A fourth aspect of the present disclosure provides the turbo machine according to the second aspect, wherein the extended space is formed by the first taper hole forming surface and a part of the outer surface of the rotating shaft, the outer surface extending from the first cylindrical portion inward in the radial direction of the rotating shaft. With the fourth aspect, the extended space can be formed without performing special machining of the first bearing.

A fifth aspect of the present disclosure provides the turbo machine according to any one of the first to fourth aspects, further including a second bearing that supports the rotating shaft; and a second supply passage for supplying a lubricating liquid between the rotating shaft and the second bearing, wherein the rotating shaft further includes a second taper portion and a second cylindrical portion, the second taper portion increasing in diameter toward the impeller on a side of the impeller opposite from the first taper portion in the axial direction of the rotating shaft, the second cylindrical portion being located adjacent to a large diameter end of the second taper portion, the second bearing includes a second taper support surface and a second cylindrical portion support surface, the second taper support surface including a second taper hole forming surface that forms a taper hole that extends toward a small diameter end of the second taper portion from a particular point on the second bearing in an axial direction of the second bearing, the second taper support surface rotatably supporting the second taper portion via the lubricating liquid, the second cylindrical portion support surface rotatably supporting the second cylindrical portion via the lubricating liquid, the second supply passage is open to a space formed between the second cylindrical portion and the second cylindrical portion support surface, and an inclination angle of the second taper hole forming surface with respect to the axial direction of the second bearing is greater than an inclination angle of an outer surface of the second taper portion with respect to the axial direction of the rotating shaft.

With the fifth aspect, for the same reason as the first bearing, the maximum value of the thrust support force of the second bearing is high. Moreover, the maximum value of the thrust support force of the second bearing can be increased without increasing the diameter of the large diameter end of the second taper portion. Therefore, the bearing loss is reduced and the turbo machine has high efficiency.

Hereinafter, embodiments of the present disclosure will be described with reference to the drawings. The following descriptions relate to an example of the present invention, and the present invention is not limited to the descriptions.

First Embodiment

Figure 2:
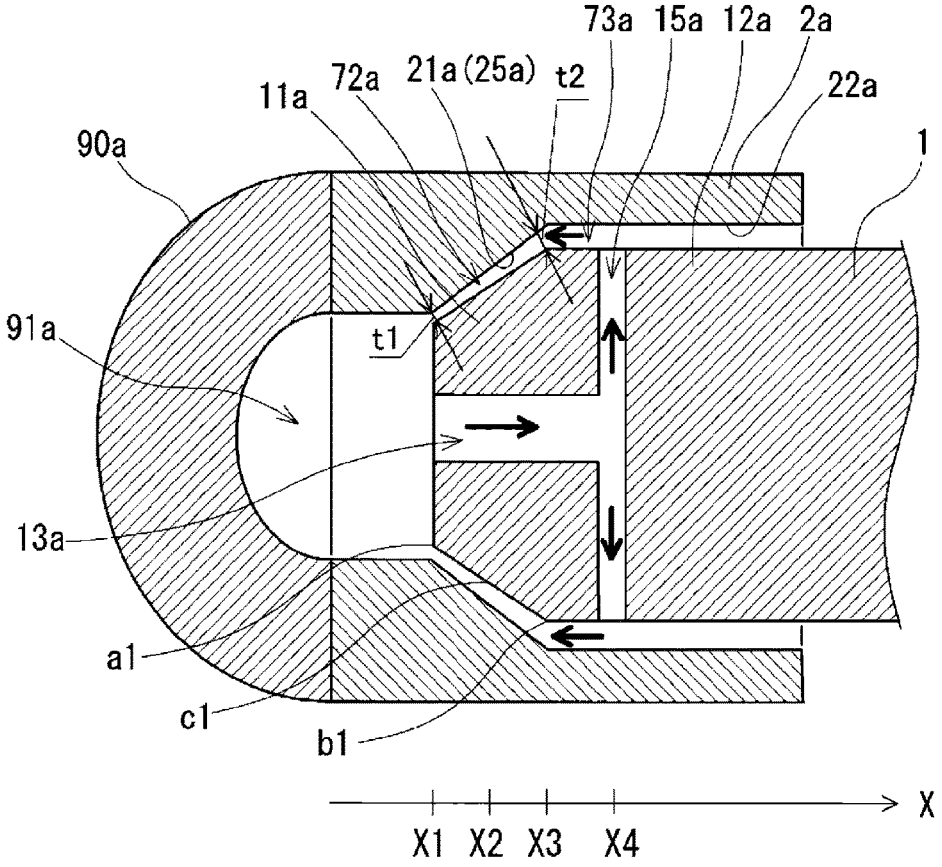
FIG. 2 is an enlarged sectional view illustrating a part of the turbo machine illustrated in FIG. 1.

As illustrated in FIGS. 1 and 2, a turbo machine 100*a* includes a rotating shaft 1, an impeller 8, a first bearing 2*a*, and a first supply passage 15*a*. The impeller 8 is fixed to the rotating shaft 1 in such a way that a working fluid intake side of the impeller 8 faces the first bearing 2*a*. The impeller 8 is a component for compressing or expanding a working fluid. The rotating shaft 1 includes a first taper portion 11*a* and a first cylindrical portion 12*a*. The first taper portion 11*a* increases in diameter toward the impeller 8 in the axial direction of the rotating shaft 1. The first cylindrical portion 12*a* is located adjacent to a large diameter end b1 of the first taper portion 11*a*. For example, the first cylindrical portion 12*a* is constant in diameter in the axial direction of the rotating shaft 1. The first bearing 2*a* includes a first taper support surface 21*a* and a first cylindrical portion support surface 22*a*. The first taper support surface 21*a* includes a first taper hole forming surface 25*a* and rotatably supports the first taper portion 11*a* via a lubricating liquid. The first taper hole forming surface 25*a* forms a taper hole that extends from a particular point on the first bearing 2*a* toward a small diameter end a1 of the first taper portion 11*a*. For example, as illustrated in FIG. 2, the particular point on the first bearing 2*a* may be adjacent to a large diameter end b1 of the first taper portion 11*a*, and the entirety of the first taper support surface 21*a* may form the first taper hole forming surface 25*a*. The first supply passage 15*a* is open to a space (first cylindrical portion space 73*a*) formed between the first cylindrical portion 12*a* and the first cylindrical portion support surface 22*a*. The inclination angle of the first taper hole forming surface 25*a* with respect to the axial direction of the first bearing 2*a* is greater than the inclination angle of the outer surface of the first taper portion 11*a* with respect to the axial direction of the rotating shaft 1. Therefore, as illustrated in FIG. 2, the width t1 between the outer surface of the first taper portion 11*a* and the first taper support surface 21*a* at the small diameter end a1 of the first taper portion 11*a* is smaller than the width t2 of a space between the outer surface of the first taper portion 11*a* and the first taper support surface 21*a* at the large diameter end b1 of the first taper portion 11*a*. In the present specification, the width between the outer surface of the first taper portion 11*a* and the first taper support surface 21*a* is the width in a direction perpendicular to the outer surface of the first taper portion 11*a*.

The turbo machine 100*a* is, for example, a turbo compressor. The turbo machine 100*a* further includes, for example, a second bearing 3, a stator 4, a rotor 5, a casing 60, a casing 62, a casing 64, support columns 61, and a lubricating liquid case 90*a*. The second bearing 3 is disposed on a side of the impeller 8 opposite from the first bearing 2*a* in the axial direction of the rotating shaft 1. The second bearing 3 rotatably supports the rotating shaft 1 in the radial direction via a lubricating liquid. The second bearing 3 is accommodated in the casing 64. For example, the second bearing 3 is attached to the inner surface of the casing 64. The rotor 5 is fixed to the rotating shaft 1 between the impeller 8 and the second bearing 3 in the axial direction of the rotating shaft 1. The second bearing 3 rotatably supports the rotating shaft 1 in the radial direction of the rotating shaft 1 via the lubricating liquid. The stator 4 is disposed so as to surround the rotor 5. For example, the stator 4 is attached to the inner surface of the casing 62. The stator 4 and the rotor 5 constitute a motor. The stator 4 generates a rotating magnetic field when electric power is supplied to the stator 4. Thus, a rotational body, including the rotor 5, the rotating shaft 1, and the impeller 8, rotates at a high speed.

The impeller 8 is accommodated in the casing 60. The inner surface of the casing 60 forms a flow passage of a working fluid. The impeller 8 has a front side 81 that faces forward. The first bearing 2*a* is supported by the support columns 61 in front of the impeller 8. The support columns 61 are fixed to the inner surface of the casing 60. The support columns 61 are arranged in the circumferential direction of the first bearing 2*a* so as to be separated from each other. The flow passage of the working fluid is formed between adjacent support columns 61. In the casing 60, a discharge passage 71 is formed outside of the impeller 8 in the radial direction.

When the impeller 8 rotates, the working fluid flows from a space in front of the impeller 8 toward the front side 81 of the impeller 8 and drawn into the impeller 8. Therefore, the front side 81 of the impeller 8 corresponds to a working fluid intake side of the impeller 8. The working fluid is accelerated and pressurized by the impeller 8, which is rotating, and is discharged to the outside of the turbo machine 100*a* through the discharge passage 71. The front side 81 of the impeller 8 receives a suction pressure of the working fluid, and a side of the impeller 8 opposite from the front side 81 receives a pressure that is substantially equal to the discharge pressure of the working fluid. Therefore, a pressure difference occurs between both sides of the impeller 8 in the axial direction of the rotating shaft 1. Due to the pressure difference, a thrust load is generated leftward in FIG. 1 in the rotational body, including the rotor 5, the rotating shaft 1, and the impeller 8. Moreover, a radial load is generated in the rotational body due to the weight of the rotational body and an unbalanced force of the rotational body.

As illustrated in FIG. 2, the lubricating liquid case 90*a* is disposed adjacent to the first bearing 2*a* on a side of the first bearing 2*a* opposite from the impeller 8 in the axial direction of the rotating shaft 1. The lubricating liquid case 90*a* forms a storing space 91*a*. The storing space 91*a* stores a lubricating liquid to be supplied to the first bearing 2*a*. The first supply passage 15*a* is formed, for example, in the rotating shaft 1 and extends to the outer surface of the first cylindrical portion 12*a* in the radial direction of the rotating shaft 1. In this case, for example, a lubricating liquid supply hole 13*a* is formed in the rotating shaft 1. The lubricating liquid supply hole 13*a* extends from an end of the rotating shaft 1 in the axial direction of the rotating shaft 1. The first supply passage 15*a* extends from the lubricating liquid supply hole 13*a* in the radial direction of the rotating shaft 1. A space in the lubricating liquid supply hole 13*a* communicates with the storing space 91*a*. Therefore, the storing space 91*a* and the first supply passage 15*a* communicate with each other through the lubricating liquid supply hole 13*a*.

When the rotating shaft 1 rotates, due to centrifugal pump effect of the rotation of the rotating shaft 1, the lubricating liquid stored in the storing space 91*a* passes through the lubricating liquid supply hole 13*a* and the first supply passage 15*a* and is supplied to the space between the first bearing 2*a* and the rotating shaft 1. Thus, a sufficient amount of lubricating liquid can be supplied to the space between the first bearing 2*a* and the rotating shaft 1. Arrows in FIG. 2 schematically show the flow of the lubricating liquid. The first supply passage 15*a* may be formed in the first bearing 2*a*. In this case, preferably, the first supply passage 15*a* is connected to a passage through which a lubricating liquid, which has been pressurized outside the first bearing 2*a* so as to have a comparatively high pressure, flows.

Due to the centrifugal pump effect of the rotation of the rotating shaft 1, the lubricating liquid, which has passed through the first supply passage 15*a* and reached the first cylindrical portion space 73*a*, has a comparatively high pressure PH near an opening of the first supply passage 15*a* in the outer surface of the first cylindrical portion 12*a*. A part of the lubricating liquid flows to the storing space 91*a* through the first cylindrical portion space 73*a* and a space (first taper portion space 72*a*) that is formed between and the first taper portion 11*a* and the first taper support surface 21*a*. The lubricating liquid in the storing space 91*a* has a comparatively low pressure PL. While the lubricating liquid flows from the first supply passage 15*a* to the storing space 91*a* through the first cylindrical portion space 73*a* and the first taper portion space 72*a*, the pressure of the lubricating liquid decreases from PH to PL due to the flow resistances of the first cylindrical portion space 73*a* and the first taper portion space 72*a*. At this time, a thrust support force is generated rightward in FIG. 2 due to the pressure of the lubricating liquid in the first taper portion space 72*a*. Thus, the thrust load of the rotational body, including the rotor 5, the rotating shaft 1, and the impeller 8, can be supported. Moreover, a radial support force is generated due to the pressure of the lubricating liquid in the first cylindrical portion space 73*a* and the first taper portion space 72*a*. Thus, the first bearing 2*a* can support the radial load acting on the rotational body.

When the rotating shaft 1 moves leftward in FIG. 1 due to the thrust load acting on the rotational body and the width of the first taper portion space 72*a* decreases, the flow resistance of the first taper portion space 72*a* increases. On the other hand, the width of the first cylindrical portion space 73*a* scarcely changes, and the flow resistance of the first cylindrical portion space 73*a* scarcely changes. The amount of change PH−PL in the pressure of the lubricating liquid, which occurs while the lubricating liquid flows from the opening of the first supply passage 15*a* to the storing space 91*a* through the first cylindrical portion space 73*a* and the first taper portion space 72*a*, is constant. The pressure drops of the lubricating liquid in the first cylindrical portion space 73*a* and in the first taper portion space 72*a* are respectively proportional to the flow resistances of the first cylindrical portion space 73*a* and the first taper portion space 72*a*. Therefore, when the rotating shaft 1 moves leftward in FIG. 1 due to the thrust load acting on the rotational body, the pressure drop of the lubricating liquid in the first cylindrical portion space 73*a* decreases and the pressure drop of the lubricating liquid in the first taper portion space 72*a* increases. Therefore, a thrust support force generated due to the pressure of the lubricating liquid in the first taper portion space 72*a* increases. However, if the first taper portion 11*a* and the first taper support surface 21*a* become too close and contact each other, the bearing loss sharply increases due to friction between the first taper portion 11*a* and the first taper support surface 21*a* and the efficiency of the turbo machine 100*a* decreases. Therefore, a thrust support force that the first bearing 2*a* generates immediately before the first taper portion 11*a* and the first taper support surface 21*a* contact each other is defined as the maximum value of the thrust support force that the first bearing 2*a* can generate.

As illustrated in FIG. 2, the following positions on the rotating shaft 1 in the axial direction (the X-axis direction) of the rotating shaft 1 are defined as follows.

X1: the small diameter end (a1)) of the first taper portion 11*a*

X2: the center (c1) of the first taper portion 11*a* in the axial direction of the rotating shaft 1

X3: the large diameter end of (b1) of the first taper portion 11*a*

X4: the opening of the first supply passage 15*a*

Figure 3:
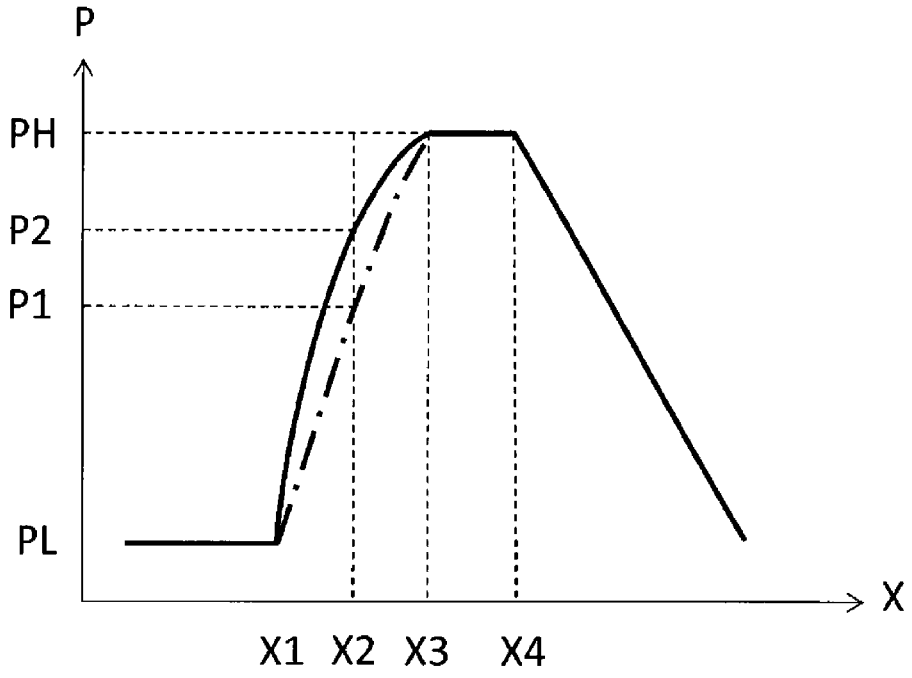
FIG. 3 shows the pressure distribution of a lubricating liquid in a bearing of the turbo machine illustrated in FIG. 2.

FIG. 3 illustrates the pressure distribution of the lubricating liquid in the first cylindrical portion space 73*a* and the first taper portion space 72*a* in the axial direction of the rotating shaft 1. A solid line in FIG. 3 represents the pressure distribution of the lubricating liquid in the turbo machine 100*a*. A chain line represents the pressure distribution of the lubricating liquid if it is assumed that the width of the first taper portion space 72*a* is constant at t1 in the entirety of the first taper portion space 72*a*. In the turbo machine 100*a*, t1<t2. Therefore, the turbo machine 100*a* has the following characteristics as compared with the case where the width of the first taper portion space 72*a* is constant at t1 in the entirety of the first taper portion space 72*a*. That it, the cross-sectional area of the flow passage in a section on the large-diameter-end side of the first taper portion space 72*a* (the section between X2 and X3) is sufficiently greater than the cross-sectional area of the of the flow passage in a section on the small-diameter-end side of the first taper portion space 72*a* (the section between X1 and X2). Therefore, the flow resistance in the section on the large-diameter-end side of the first taper portion space 72*a* is small. The amount of change PH−PL in the pressure of the lubricating liquid, which occurs while the lubricating liquid flows from the opening of the first supply passage 15*a* to the storing space 91*a* through the first cylindrical portion space 73*a* and the first taper portion space 72*a*, is constant. The pressure drops of the lubricating liquid in the section on the large-diameter-end side of the first taper portion space 72*a* and in the section on the small-diameter-end side of the first taper portion space 72*a* are respectively proportional to the flow resistances in these sections. Therefore, as illustrated in FIG. 3, the pressure of the lubricating liquid at the position X2 in the turbo machine 100*a* is increased to P2 from P1, where P1 is the pressure in the case where the width of the first taper portion space 72*a* is constant at t1 in the entirety of the first taper portion space 72*a*. As a result, the average pressure of the lubricating liquid in the entirety of the first taper portion space 72*a* is increased, and it is possible to generate a greater thrust support force than the case where the width of the first taper portion space 72*a* is constant at t1 in the entirety of the first taper portion space 72*a*. This effect occurs because the flow resistance in the section on the small-diameter-end side of the first taper portion space 72*a* increases as t1 decreases. Therefore, the effect can be obtained when t1 is small.

Figure 4:
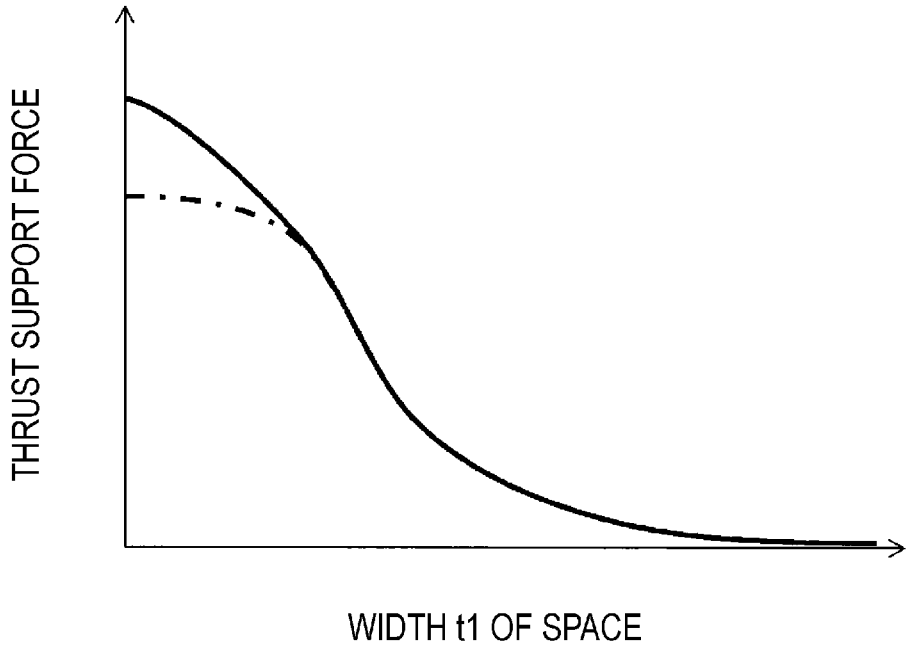
FIG. 4 shows the relationship between the magnitude of a thrust support force and the width t1 of a space of the bearing of the turbo machine illustrated in FIG. 2.

As illustrated in FIG. 4, as the width t1 of the space decreases, the thrust support force of the first bearing 2*a* continuously increases until the width t1 of the space becomes considerably small. A solid line in FIG. 4 represents the relationship between the thrust support force of the first bearing 2*a* and the width t1 of the space in the turbo machine 100*a*. A chain line in FIG. 4 represents the relationship between the thrust support force of the first bearing 2*a* and the width t1 of the space if it is assumed that the width of the first taper portion space 72*a* is constant at t1 in the entirety of the first taper portion space 72*a*. As illustrated in FIG. 4, in the case where the width of the first taper portion space 72*a* is constant at t1 in the entirety of the first taper portion space 72*a*, the thrust support force scarcely increases even when the width t1 of the space becomes smaller than a predetermined value. This is because, in the case where the width of the first taper portion space 72*a* is constant at t1 in the entirety of the first taper portion space 72*a*, the flow resistance of the section on the large-diameter-end side of the first taper portion space 72*a* increases when the width t1 of the space becomes smaller than the predetermined value. In contrast, with the first bearing 2*a* of the turbo machine 100*a*, even when the width t1 of the space is smaller than a predetermined value, the flow resistance of the section on the large-diameter-end side of the first taper portion space 72*a* is prevented from becoming too large. Therefore, as illustrated in FIG. 4, the thrust support force can be increased even when the width t1 of the space is smaller than the predetermined value. Accordingly, the maximum value of the thrust support force in the first bearing 2*a* can be increased without increasing the diameter of the large diameter end b1 of the first taper portion 11*a*. Thus, a loss that occurs in the first taper portion space 72*a* due to the viscosity of the loricating liquid is reduced, and therefore the turbo machine 100*a* has high efficiency.

Modifications

The turbo machine 100*a* can be modified in various ways. For example, in the turbo machine 100*a*, the impeller 8 may be a component for expanding a working fluid. In this case, the impeller 8 obtains a rotational force by using the kinetic energy of the working fluid. In this case, the rotating shaft 1 is preferably connected to a generator. Thus, the rotational force obtained by the impeller 8 can be converted to electric energy.

Figure 5:
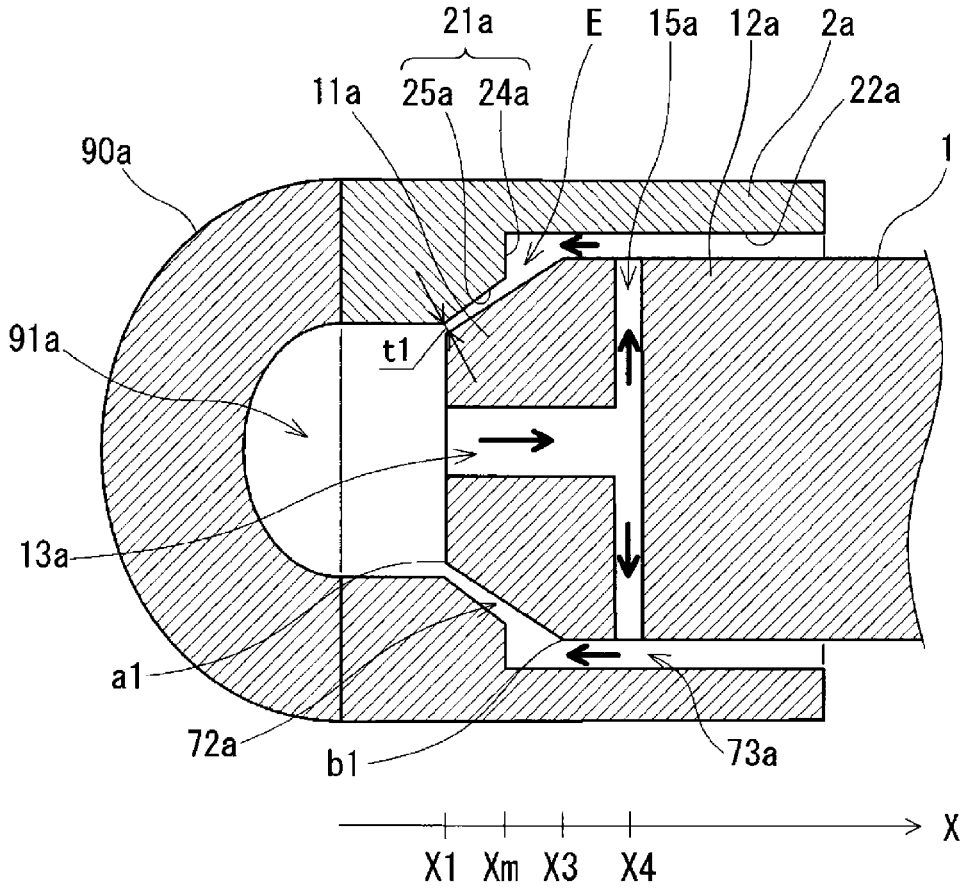
FIG. 5 is an enlarged sectional view illustrating a part of a turbo machine according to a modification.

As illustrated in FIG. 5, for example, in the turbo machine 100*a*, the outer surface of the rotating shaft 1 and the inner surface of the first bearing 2*a* may form an extended space E at a position adjacent to the large diameter end b1 of the first taper portion 11*a*. The extended space E has a width in the radial direction of the first bearing 2*a*, the width being greater than the width of a space between the outer surface of the first cylindrical portion 12*a* and the first cylindrical portion support surface 22*a*.

As illustrated in FIG. 5, the extended space E is formed, for example, by an inner surface 24*a* of the first bearing 2*a* and the outer surface of the first taper portion 11*a*, the inner surface 24*a* extending from the first taper hole forming surface 25*a* outward in the radial direction of the first bearing 2*a* between the first cylindrical portion support surface 22*a* and the first taper hole forming surface 25*a* in the axial direction of the rotating shaft 1. Thus, the extended space E can be formed without performing special machining of the rotating shaft 1. In this case, the first taper support surface 21*a* includes the inner surface 24*a*, in addition the first taper hole forming surface 25*a*.

The extended space E has, for example, an annular shape in the circumferential direction of the rotating shaft 1. According to circumstances, the extended space E need not have an annular shape in the circumferential direction of the rotating shaft 1.

As illustrated in FIG. 5, the following positions on the rotating shaft 1 in the axial direction (the X-axis direction) of the rotating shaft 1 are defined as follows.

X1: the small diameter end (a1)) of the first taper portion 11*a*

Xm: the boundary between the inner surface 24*a* of the first bearing 2*a*, which forms the extended space E, and the first taper hole forming surface 25*a*

X3: the large diameter end of (b1) of the first taper portion 11*a*

X4: the opening of the first supply passage 15*a*

Figure 6:
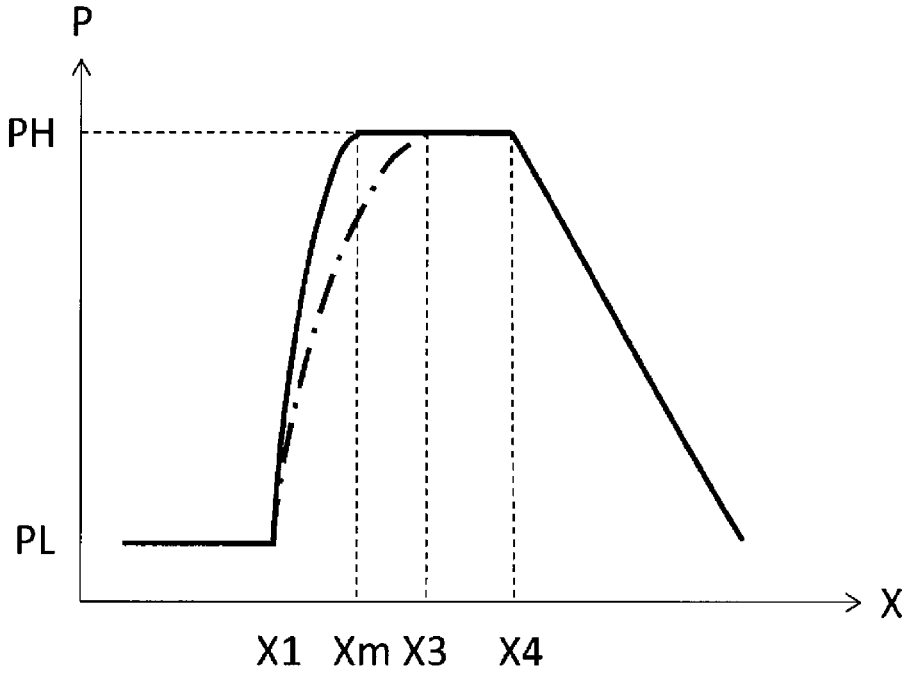
FIG. 6 shows the pressure distribution of a lubricating liquid in a bearing of the turbo machine illustrated in FIG. 5.

A solid line in FIG. 6 represents the pressure distribution of a lubricating liquid in the first taper portion space 72*a* in the case where the extended space E is formed as illustrated in FIG. 5. A chain line in FIG. 6 represents the pressure distribution of a lubricating liquid in the first taper portion space 72*a* in the case where the extended space E is not formed in the first taper portion space 72*a* as illustrated in FIG. 2. As illustrated in FIG. 6, the pressure of the lubricating liquid in the extended space E is PH, because the lubricating liquid becomes stagnant in the extended space E. Thus, compared with the case where the extended space E is not formed in the first taper portion space 72*a*, the average pressure of the lubricating liquid in the entirety of the first taper portion space 72*a* is further increased. Therefore, the thrust support force generated in the first bearing 2*a* is increased.

Figure 7:
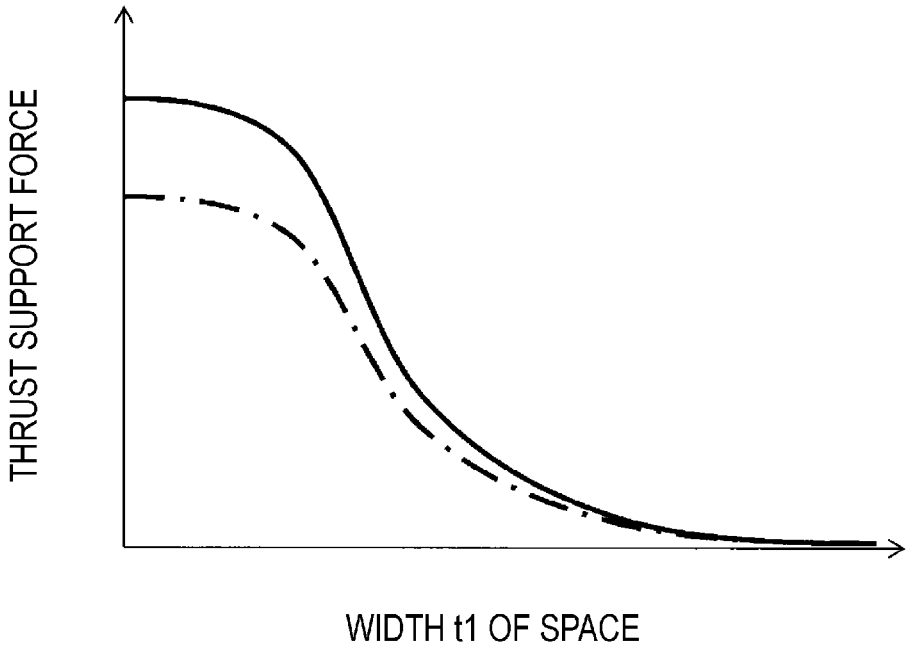
FIG. 7 shows the relationship between the magnitude of a thrust support force and the width t1 of a space of the bearing of the turbo machine illustrated in FIG. 5.

Because the flow resistance in the extended space E is smaller than the flow resistance in the first taper portion space 72*a* when the extended space E is not formed in the first taper portion space 72*a*, the lubricating liquid becomes stagnant in the extended space E at the pressure PH even when the width t1 of the space is greater than a predetermined value. Therefore, as illustrated in FIG. 7, when the extended space E is formed, the thrust support force can be increased even when the width t1 of the space is comparatively large. Therefore, the first bearing 2*a* generates a large thrust support force, even when the thrust load acting on the rotational body, including the rotor 5, the rotating shaft 1, and the impeller 8, is comparatively small. As a result, the width of the space between the outer surface of the first taper portion 11*a* and the first taper support surface 21*a* in the first taper portion space 72*a* becomes comparatively large, and therefore the loss generated due to the viscosity of the lubricating liquid in the first taper portion space 72*a* is reduced. Consequently, the turbo machine 100*a* has high efficiency. A solid line in FIG. 7 represents the relationship between the thrust support force of the first bearing 2*a* and the width t1 of the space when the extended space E is formed as illustrated in FIG. 5. A chain line in FIG. 7 represents the relationship between the thrust support force of the first bearing 2*a* and the width t1 of the space when it is assumed that the width of the first taper portion space 72*a* is constant at t1 in the entirety of the first taper portion space 72*a*.

Figure 8:
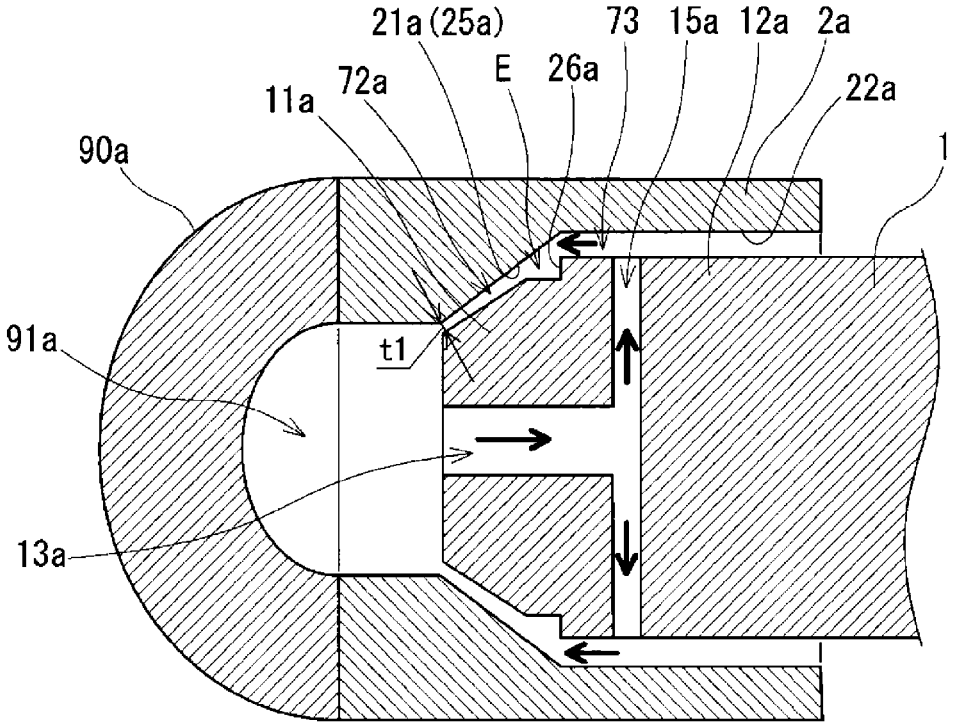
FIG. 8 is an enlarged sectional view illustrating a part of a turbo machine according to another modification.

As illustrated in FIG. 8, an extended space E may be formed, for example, by the first taper hole forming surface 25*a* and an outer surface 26*a* of the rotating shaft 1, the outer surface 26*a* extending from the first cylindrical portion 11*a* inward in the radial direction of the rotating shaft 1. Also in this case, compared with the case where the extended space E is not formed in the first taper portion space 72*a*, the average pressure of the lubricating liquid in the entirety of the first taper portion space 72*a* can be increased. Moreover, the extended space E can be formed without performing special machining of the first bearing 2*a*.

Second Embodiment

Next, a turbo machine 100*b* according to a second embodiment will be described. Unless otherwise noted, the turbo machine 100*b* has the same structure as the turbo machine 100*a*. Elements of the turbo machine 100*b* that are the same as or correspond to those of the turbo machine 100*a* will be denoted by the same numerals, and detailed descriptions of such elements will be omitted. Descriptions of the first embodiment are applicable to the second embodiment unless they are technologically contradictory.

Figure 9:
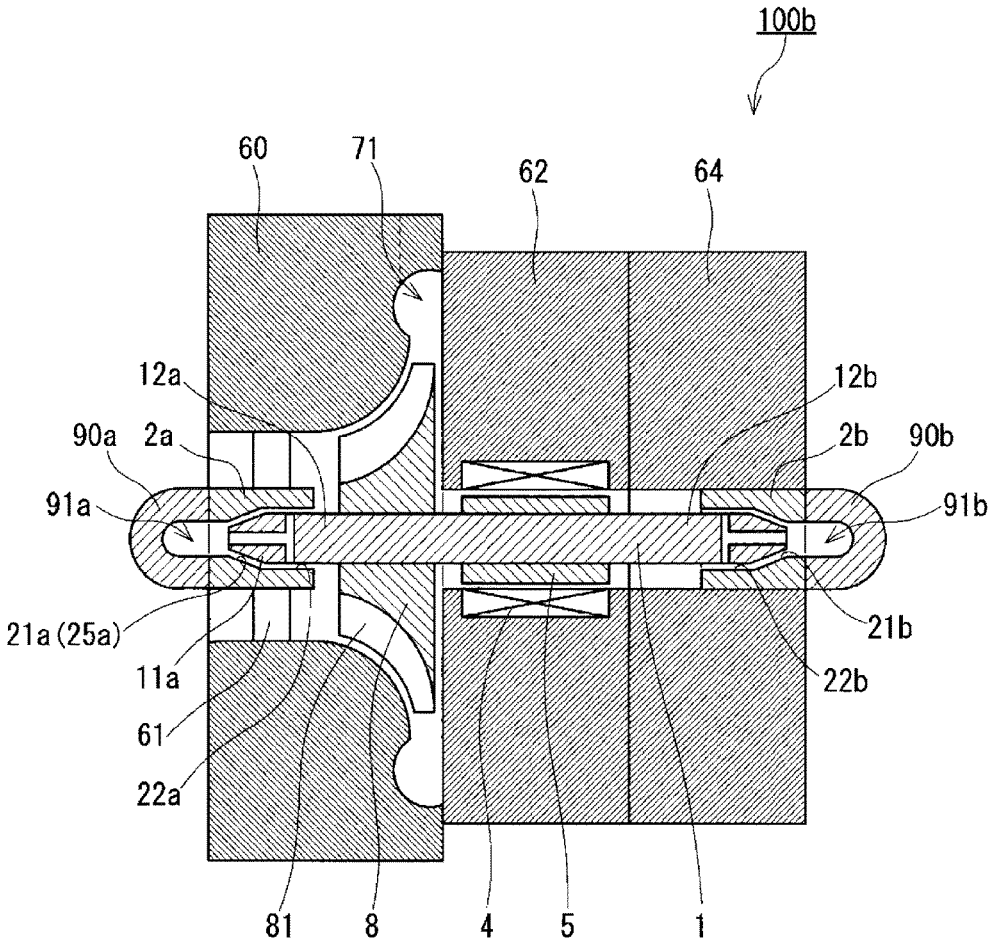
FIG. 9 illustrates a turbo machine according to a second embodiment.
Figure 10:
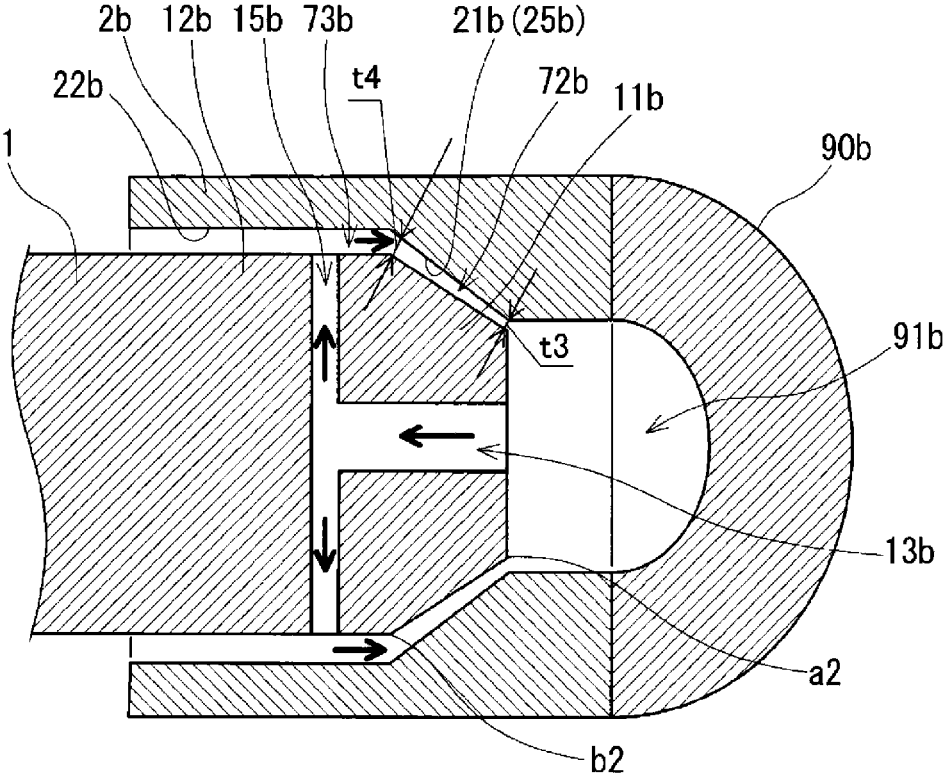
FIG. 10 is an enlarged sectional view illustrating a part of the turbo machine illustrated in FIG. 9.
Figure 11:
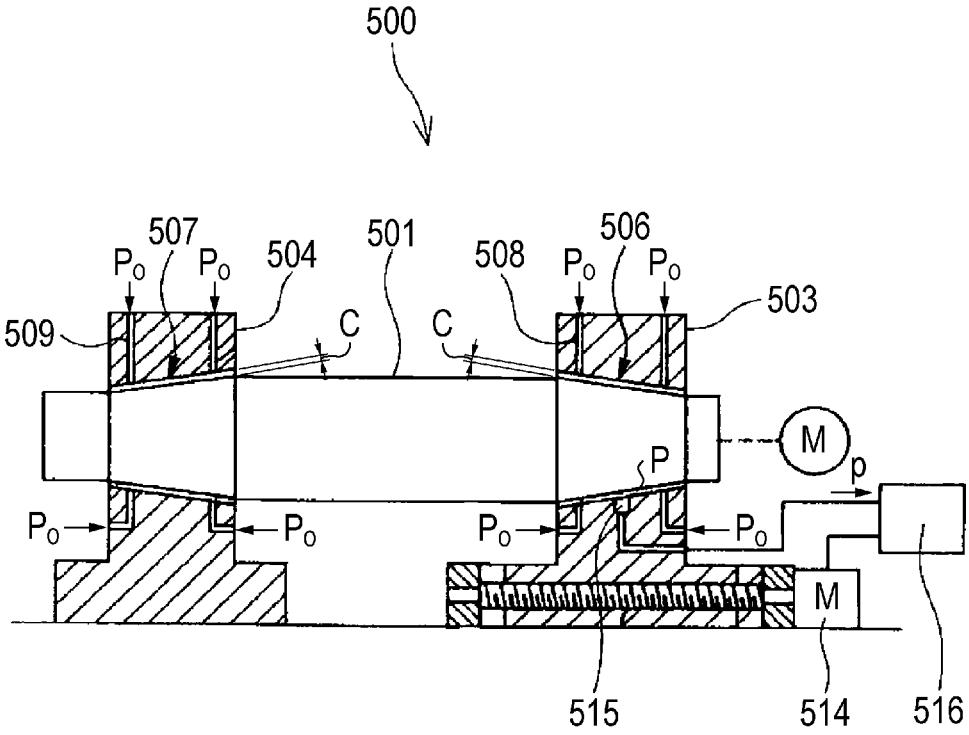
FIG. 11 is a sectional view of an existing air bearing device.

As illustrated in FIGS. 9 and 10, the turbo machine 100*b* further includes a second bearing 2*b* and a second supply passage 15*b*, in addition to the rotating shaft 1, the impeller 8, the first bearing 2*a*, and the first supply passage 15*a*. The second bearing 2*b* supports the rotating shaft 1. The second supply passage 15*b* is a passage for supplying a lubricating liquid between the rotating shaft 1 and the second bearing 2*b*. The rotating shaft 1 further includes a second taper portion 11*b* and a second cylindrical portion 12*b*. The second taper portion 11*b* increases in diameter toward the impeller 8 in the axial direction of the rotating shaft 1 on a side of the impeller 8 opposite from the first taper portion 11*a* in the axial direction. The second cylindrical portion 12*b* is located adjacent to a large diameter end b2 of the second taper portion 11*b*. For example, the second cylindrical portion 12*b* is constant in diameter in the axial direction of the rotating shaft 1. The second bearing 2*b* has a second taper support surface 21*b* and a second cylindrical portion support surface 22*b*. The second taper support surface 21*b* includes a second taper hole forming surface 25*b* and rotatably supports the second taper portion 11*b* via a lubricating liquid. The second taper hole forming surface 25*b* forms a taper hole that extends from a particular point on the second bearing 2*b* toward a small diameter end a2 of the second taper portion 11*b*. For example, as illustrated in FIG. 10, the particular point on the second bearing 2*b* may be adjacent to the large diameter end b2 of the second taper portion 11*b*, or the entirety of the second taper support surface 21*b* may form the second taper hole forming surface 25*b*. The second supply passage 15*b* is open to a space (second cylindrical portion space 73*a*) formed between the second cylindrical portion 12*b* and the second cylindrical portion support surface 22*b*. The inclination angle of the second taper hole forming surface 25*b* with respect to the axial direction of the second bearing 2*b* is greater than the inclination angle of the outer surface of the second taper portion 11*b* with respect to the axial direction of the rotating shaft 1. Therefore, as illustrated in FIG. 10, the width t3 between the outer surface of the second taper portion 11*b* and the second taper support surface 21*b* at the small diameter end a2 of the second taper portion 11*b* is smaller than the width t4 of a space between the outer surface of the second taper portion 11*b* and the second taper support surface 21*b* at the large diameter end b2 of the second taper portion 11*b*. The width between the outer surface of the second taper portion 11*b* and the second taper support surface 21*b* is the width in a direction perpendicular to the outer surface of the second taper portion 11*b*.

As with the turbo machine 100*a*, when the turbo machine 100*b* is being operated normally, a thrust load is generated in the rotational body, including the rotating shaft 1, the rotor 5, and the impeller 8, leftward in FIG. 9. However, depending on the operating conditions of the turbo machine 100*b*, a thrust load may be generated rightward in FIG. 9. In this case, with the turbo machine 100*b*, a thrust support force is generated by the pressure of the lubricating liquid in a space (second taper portion space 72*b*) formed between the second taper portion 11*b* and the second taper support surface 21*b*. Thus, the second bearing 2*b* supports the thrust load acting on the rotational body rightward in FIG. 9. For the same reason described regarding the first bearing 2*a*, the average pressure of the lubricating liquid in the entirety of the second taper portion space 72*b* is increased. As a result, it is possible to generate a thrust support force that is greater than that of a case where the width of the second taper portion space 72*b* is constant at t3 in the entirety of the second taper portion space 72*b*.

The turbo machine 100*b* includes, for example, a lubricating liquid case 90*b*. The lubricating liquid case 90*b* is disposed adjacent to the second bearing 2*b* on a side of the second bearing 2*b* opposite from the impeller 8 in the axial direction of the rotating shaft 1. The lubricating liquid case 90*b* forms a storing space 91*b*. The storing space 91*b* stores a lubricating liquid to be supplied to the second bearing 2*b*. The second supply passage 15*b* is formed, for example, in the rotating shaft 1 and extends to the outer surface of the second cylindrical portion 12*b* in the radial direction of the rotating shaft 1. In this case, for example, a lubricating liquid supply hole 13*b* is formed in the rotating shaft 1. The lubricating liquid supply hole 13*b* extends from an end of the rotating shaft 1 in the axial direction of the rotating shaft 1. The second supply passage 15*b* extends from the lubricating liquid supply hole 13*b* in the radial direction of the rotating shaft 1. The space in the lubricating liquid supply hole 13*b* communicates with the storing space 91*b*. Therefore, the storing space 91*b* and the second supply passage 15*b* communicate with each other through the lubricating liquid supply hole 13*b*.

When the rotating shaft 1 rotates, due to the centrifugal pump effect of the rotation of the rotating shaft 1, the lubricating liquid stored in the storing space 91*b* passes through the lubricating liquid supply hole 13*b* and the second supply passage 15*b* and is supplied to the space between the second bearing 2*b* and the rotating shaft 1. Thus, a sufficient amount of lubricating liquid can be supplied to the space between the second bearing 2*b* and the rotating shaft 1. Arrows in FIG. 10 schematically show the flow of the lubricating liquid. The second supply passage 15*b* may be formed in the second bearing 2*b*. In this case, preferably, the second supply passage 15*b* is connected to a passage through which a lubricating liquid, which has been pressurized outside the second bearing 2*b* so as to have a comparatively high pressure, flows.

The turbo machine according to the present disclosure is useful as a compressor of a refrigeration cycle device that is used in turbo freezers or commercial air conditioners.

REFERENCE SIGNS LIST

1: rotating shaft
2*a*: first bearing
2*b*: second bearing
8: impeller
11*a*: first taper portion
11*b*: second taper portion
12*a*: first cylindrical portion
12*b*: second cylindrical portion
15*a*: first supply passage
15*b*: second supply passage
21*a*: first taper support surface
21*b*: second taper support surface
22*a*: first cylindrical portion support surface
22*b*: second cylindrical portion support surface
25*a*: first taper hole forming surface
25*b*: second taper hole forming surface
100*a*, 100*b*: turbo machine
E: extended space

What is claimed is:

1. A turbo machine comprising:
a rotating shaft;
an impeller;

a first bearing that supports the rotating shaft; and a first supply passage for supplying a lubricating liquid between the rotating shaft and the first bearing, wherein the impeller is fixed to the rotating shaft, a working fluid intake side of the impeller facing the first bearing, the rotating shaft includes a first taper portion and a first cylindrical portion, the first taper portion increasing in diameter toward the impeller in an axial direction of the rotating shaft, the first cylindrical portion being located adjacent to a large diameter end of the first taper portion, the first bearing includes a first taper support surface and a first cylindrical portion support surface, the first taper support surface including a first taper hole forming surface that forms a taper hole that extends toward a small diameter end of the first taper portion from a particular point on the first bearing in an axial direction of the first bearing, the first taper support surface rotatably supporting the first taper portion via the lubricating liquid, the first cylindrical portion support surface rotatably supporting the first cylindrical portion via the lubricating liquid, the first supply passage is open to a space formed between the first cylindrical portion and the first cylindrical portion support surface, and an inclination angle of the first taper hole forming surface with respect to the axial direction of the first bearing is greater than an inclination angle of an outer surface of the first taper portion with respect to the axial direction of the rotating shaft.

2. The turbo machine according to claim 1, wherein an outer surface of the rotating shaft and an inner surface of the first bearing form an extended space at a position adjacent to the large diameter end of the first taper portion, the extended space having a width in the radial direction of the first bearing, the width being greater than a width of a space between an outer surface of the first cylindrical portion and the first cylindrical portion support surface.

3. The turbo machine according to claim 2, wherein the extended space is formed by the inner surface of the first bearing and the outer surface of the first taper portion, the inner surface extending from the first taper hole forming surface outward in the radial direction of the first bearing between the first cylindrical portion support surface and the first taper hole forming surface in the axial direction of the rotating shaft.

4. The turbo machine according to claim 2, wherein the extended space is formed by the first taper hole forming surface and a part of the outer surface of the rotating shaft, the outer surface extending from the first cylindrical portion inward in the radial direction of the rotating shaft.

5. The turbo machine according to claim 1, further comprising:

a second bearing that supports the rotating shaft; and a second supply passage for supplying a lubricating liquid between the rotating shaft and the second bearing, wherein the rotating shaft further includes a second taper portion and a second cylindrical portion, the second taper portion increasing in diameter toward the impeller on a side of the impeller opposite from the first taper portion in the axial direction of the rotating shaft, the second cylindrical portion being located adjacent to a large diameter end of the second taper portion, the second bearing includes a second taper support surface and a second cylindrical portion support surface, the second taper support surface including a second taper hole forming surface that forms a taper hole that extends toward a small diameter end of the second taper portion from a particular point on the second bearing in an axial direction of the second bearing, the second taper support surface rotatably supporting the second taper portion via the lubricating liquid, the second cylindrical portion support surface rotatably supporting the second cylindrical portion via the lubricating liquid, the second supply passage is open to a space formed between the second cylindrical portion and the second cylindrical portion support surface, and an inclination angle of the second taper hole forming surface with respect to the axial direction of the second bearing is greater than an inclination angle of an outer surface of the second taper portion with respect to the axial direction of the rotating shaft.

* * * * *